US010266001B2

(12) United States Patent
Porter

(10) Patent No.: US 10,266,001 B2
(45) Date of Patent: Apr. 23, 2019

(54) DRIP RESISTANT WOOD GRAINING PROCESS

(71) Applicant: Disney Enterprises, Inc., Burbank, CA (US)

(72) Inventor: Steven Porter, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 798 days.

(21) Appl. No.: 14/791,131

(22) Filed: Jul. 2, 2015

(65) Prior Publication Data

US 2017/0001469 A1 Jan. 5, 2017

(51) Int. Cl.

| | |
|---|---|
| ***B44F 9/02*** | (2006.01) |
| ***B05D 5/00*** | (2006.01) |
| ***B44C 5/06*** | (2006.01) |

(52) U.S. Cl.

CPC ..... *B44F 9/02* (2013.01); *B05D 5/00* (2013.01); *B44C 5/06* (2013.01)

(58) Field of Classification Search

CPC ..... B44F 9/02; B05D 5/00; B44C 5/06

USPC ..... 156/293, 294

See application file for complete search history.

(56) References Cited

U.S. PATENT DOCUMENTS 3,498,038 A * 3/1970 Schulver

* cited by examiner

*Primary Examiner* — Vishal I Patel

(74) *Attorney, Agent, or Firm* — Patent Ingenuity, P.C.; Samuel K. Simpson

(57) ABSTRACT

A process provides two or more strands of rope formed of a fibrous matrix material. Further, the process threads the strands singly and in parallel under tension into a coating container. In addition, the process applies a curable fluid matrix to at least some of the strands. The process also draws the strands through a constricting orifice to bond them together along their length to form a composite rope. Further, the process cures the composite rope to form a rigid structure. An apparatus comprises an armature, a wire mesh that is operably attached to the armature, and an epoxy coated rope that is operably attached to the wire mesh. The epoxy coated rope comprises glass fiber.

4 Claims, 8 Drawing Sheets

DRIP RESISTANT WOOD GRAINING PROCESS

BACKGROUND

1. Field

This disclosure generally relates to the field of wood graining systems. More particularly, the disclosure relates to wood graining systems for artificial props.

2. General Background

Artificial props are typically used as an alternative to real objects in a variety of environments such as theme parks, zoos, aquariums, etc., since such artificial props are typically much less expensive than the corresponding real objects. Such props may include wood grained props, i.e., props that have the appearance of an arrangement of wood fibers and the texture of such arrangement. The wood grained props may have a straight grain arrangement of fibers, i.e., fibers that run parallel to the longitudinal axis of the artificial prop, or a cross grain arrangement of fibers, i.e., fibers that run in a spiral or a diagonal pattern with respect to the longitudinal axis of the artificial prop. Use of such artificial props typically necessitates significantly less expensive maintenance than real props. For example, watering and trimming of the artificial props is not necessary.

Yet, the artificial wood props often lack the durability of the corresponding real props. For example, artificial wood props tend to lose their realistic appearance, melt, drip, fall apart, break, etc. when present in a harsh weather environment. Further, artificial wood props must be implemented in a way that meets the high safety standards of an entertainment environment, e.g., a theme park. For example, in the event of high heat or fire, the artificial wood props should resist burning, melting, and dripping. Further, construction of the artificial wood props often involves significant skilled manual labor. An expensive epoxy would typically have to be obtained and then manually sculpted to form the artificial props. In addition, current construction methods often lead to artificial wood props that are heavy. As a result, moving the artificial wood props to different locations in a particular environment can be quite difficult. Weight may constrain the construction of large props and may require more complex and expensive support structures such as flooring and framing to support them.

Therefore, current wood graining processes do not provide a cost effective and resource effective approach to generating artificial wood props. A process for generating a safe, flexible, and durable artificial wood prop in a cost effective and realistic manner is needed.

SUMMARY

A process provides two or more strands of rope formed of a fibrous matrix material. Further, the process threads the strands singly and in parallel under tension into a coating container. In addition, the process applies a curable fluid matrix to at least some of the strands. The process also draws the strands through a constricting orifice to bond them together along their length to form a composite rope. Further, the process cures the composite rope to form a rigid structure.

Further, an apparatus comprises an armature, a wire mesh that is operably attached to the armature, and an epoxy coated rope that is operably attached to the wire mesh. The epoxy coated rope comprises glass fiber.

In addition, an apparatus comprises a container. The apparatus also comprises a first wall that is operably attached to the container. Further, the apparatus has a plurality of orifices in the first wall. Each of the plurality of orifices is sized to receive strands of rope. The rope comprises an inflammable fiber. In addition, the apparatus has a second wall that is operably attached to the container and through which the strands of rope are intertwined to form a composite rope after epoxy is applied to the strands of rope in the container.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

DETAILED DESCRIPTION

An artificial wood process is provided to generate an artificial wood prop that is heat resistant, exhibits improved safety performance, and that also provides a realistic natural wood grain texture. The resulting artificial wood prop is a realistic, cost effective, lightweight, drip resistant, flexible, and melt resistant prop that can be used in harsh weather environments, entertainment environments that use special effects, etc.

Figure 1A:
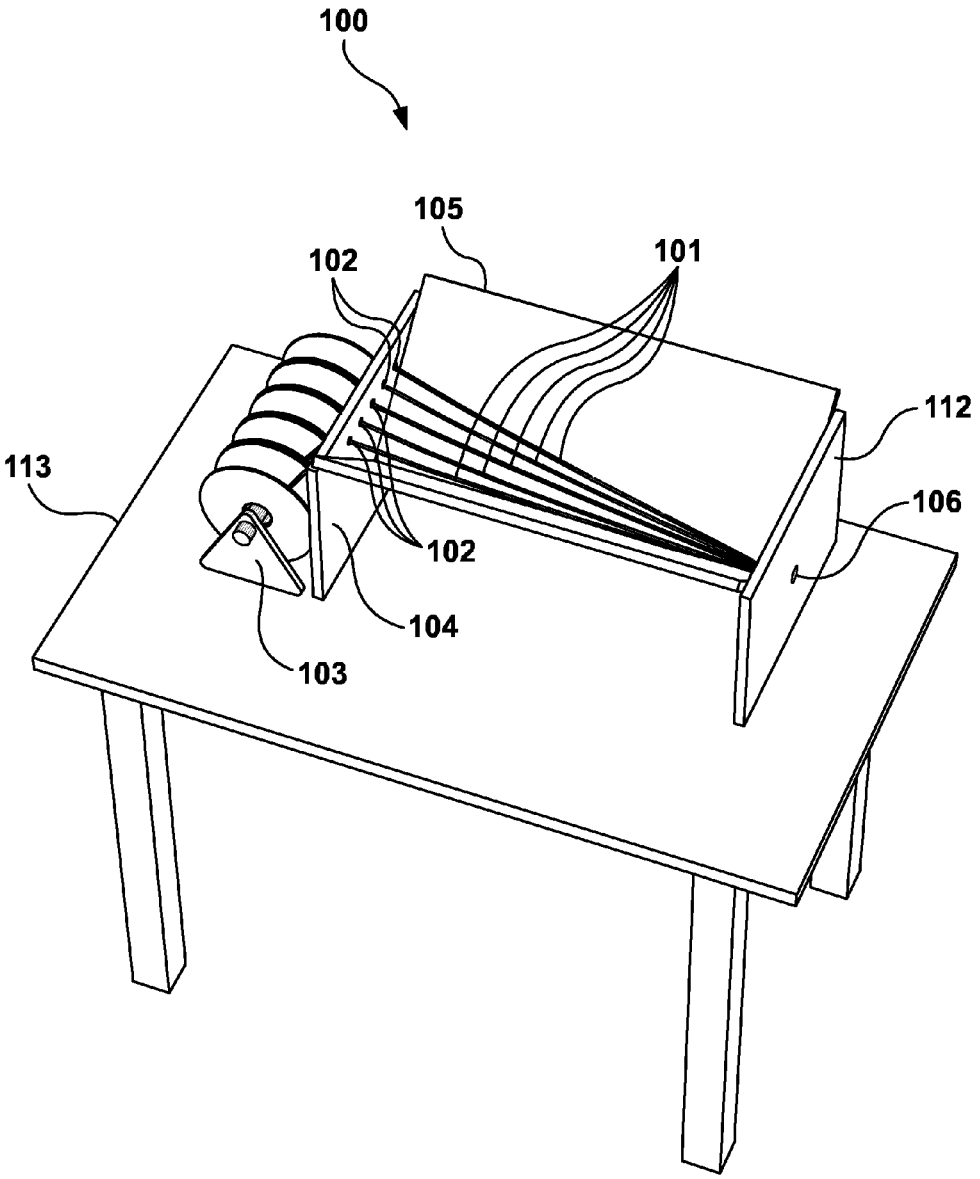
FIG. 1A illustrates an epoxy applicator.

FIG. 1A illustrates an epoxy applicator 100. The epoxy applicator 100 is used to apply an epoxy to strands of rope 101 that comprise a fibrous matrix material. The fibrous matrix material may be an inflammable fiber such as glass fiber, carbon fiber, Kevlar fiber, hybrids that comprise more than one of the preceding fibers, and the like. The radius of each strand of rope 100 can range from a yarn, twine, cord, thread, rope, etc. Further, the strands of rope 101 can each have the same dimensions or differ in dimensions to provide a particular aesthetic look, strength, and texture. In addition, the strands of rope 101 may vary in composition or color. The strands of rope 101 are wound around a spindle 103. Each of the strands of rope 101 is then inserted through one of a plurality of orifices 102 of a wall of 104 of a container 105 and through an orifice 106 of a wall 112 on the other end of the container 105. The container 105 maintains tension in each of the strands of rope 101 so that epoxy can be effectively applied. Further, the container 105 has an opening on the top of the container 105 so that epoxy can be applied through the container 105. The epoxy application may be situated on a table 113 or other structure to elevate the epoxy applicator 100 for epoxy application.

Figure 1B:
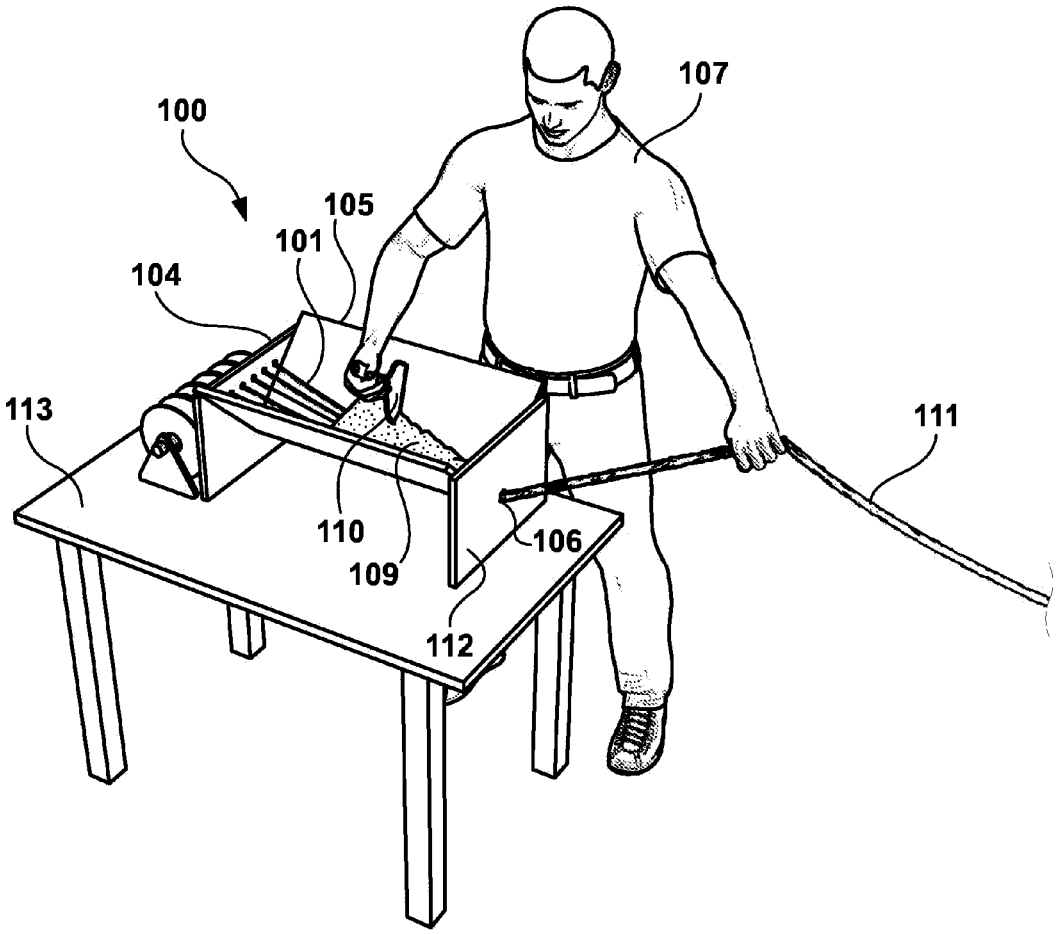
FIG. 1B illustrates a human using the epoxy applicator to apply epoxy to each of the strands of rope so that each of the strands of rope has an epoxy coating.

FIG. 1B illustrates an operator 107 using the epoxy applicator 100 to apply epoxy 109 to each of the strands of rope 101 so that each of the strands of rope 101 has an epoxy coating. The operator 107 may use an implement 110 such as a shovel, scraper, etc. to apply the epoxy 109. The epoxy 109 is just an example of a curable fluid matrix that is fluid during application, but hardens upon curing. The epoxy 109 is applied to the strands of rope 101 as the epoxy 109 is drip resistant at high temperatures. Other types of a curable fluid matrix that are drip resistant at high temperatures may be used instead or in addition to the epoxy 109. For instance, fillers such as colorant, flame retardant, strengtheners, etc. may be used in conjunction with the epoxy 109. As an example, bentonite clays can improve fire resistance and dripping performance in epoxy.

In one embodiment, the epoxy 109 coats the surface of at least some of the strands of rope 101. In another embodiment, the epoxy 109 saturates or fills the volume of at least some of the strands of rope 101. The operator 107 may then pull the rope 101 through the orifice 106 such that the strands of rope 101 take the form of a composite rope 111. For example, the composite rope 111 may be the strands of rope 101 twisted in a form that provides the appearance of a vine. The dimensions of the orifice 106 may vary. For example, the dimensions of the orifice 106 may have small enough dimensions relative to the strands of rope 101 to squeegee off excess epoxy. Further, the dimensions of the orifice 106 may have small enough dimensions relative to the strands of rope 101 to compress the composite rope 111 to ensure bonding.

Although the epoxy applicator 100 is illustrated in FIGS. 1A and 1B for applying the epoxy 109 to the strands of rope 101, the epoxy applicator 100 is just an example of a device that may be used for such application. Other configurations may be used to apply the epoxy 109 to the strands of rope 101 so long as they provide adequate coverage and saturation of strands 101 to meet the structural and aesthetic needs of a particular application.

Further, the epoxy 109 may be applied to only one rope 101 rather than strands of rope 101. In other words, the epoxy 109 may be used for a rope 101 that is not combined into a composite rope 111. Similarly, epoxy 109 may be applied to fewer than all the strands 101.

The composite rope 111 may be used in environments in a fire-safe manner since the rope 101 is heat resistant as a result of its glass fiber composition and the epoxy 109 is drip resistant when exposed to high temperatures. The epoxy 109 provides the composite rope 111 with a wood grain texture that is realistic and that can be applied over a variety of substrates. Further, the epoxy 109 can have a color that conforms to the artificial prop to which the composite rope 111 is a part of so that the need for repainting is diminished. In other words, an intrinsic colorant can be used in the composite rope 111 to match the color of the artificial prop.

Figure 2A:
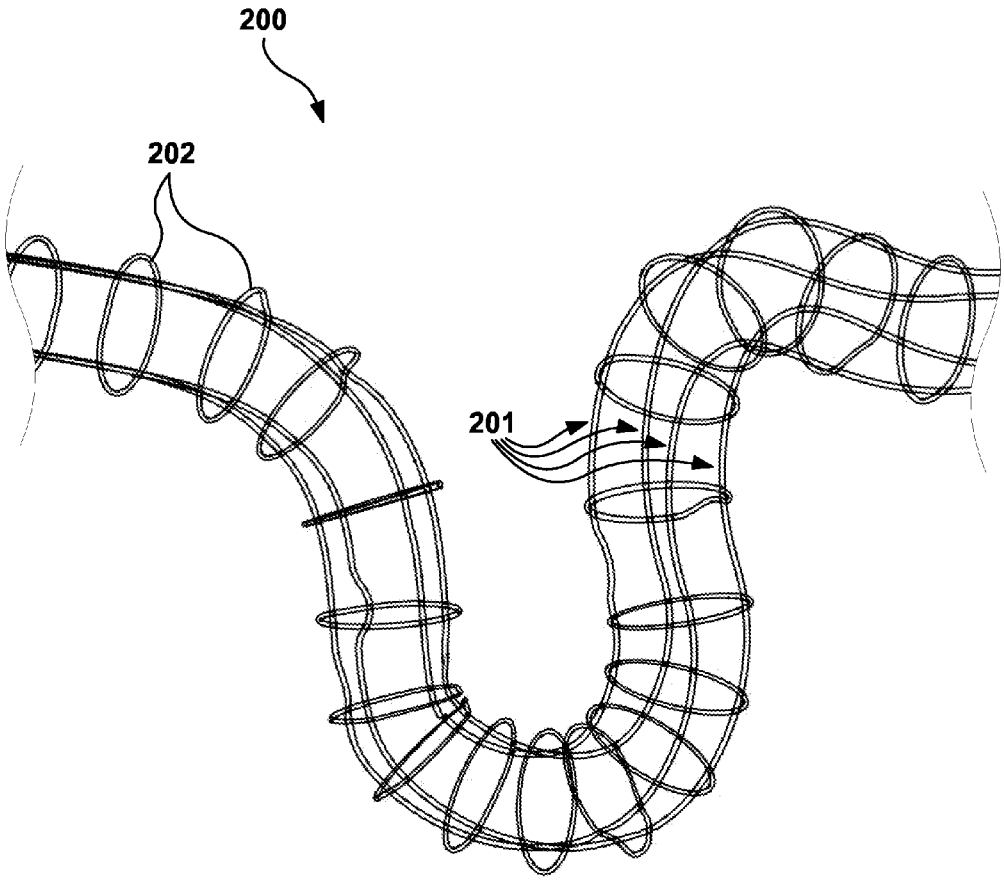
FIG. 2A illustrates an armature to which the composite rope illustrated in FIG. 1B can be applied.

FIG. 2A illustrates an armature 200 to which the composite rope 111 illustrated in Figure 111 can be applied. For example, the operator 107 illustrated in FIG. 1B may want to construct an artificial prop that resembles a tree branch. The armature 200 can be assembled, e.g., welded, with a durable material, e.g., steel. The armature 200 comprises a plurality of wires 201, e.g., steel wires. Other materials other than steel may be used for the armature 200 and the plurality of wires 201. The selection of the materials can be based on rigidity, malleability, cost, fire resistance, environmental robustness, etc. Further, a plurality of reinforcing rings 202 are operably attached to the plurality of wires 201. The armature 200 can be the artificial prop or can surround the artificial prop.

The armature 200 is configured to be lightweight so that the armature 200 can be moved to different locations, e.g., different theme park shows, without difficulty. Yet, the armature 200 is also durable enough to maintain its form through inclement weather, e.g., hurricane force winds.

Figure 2B:
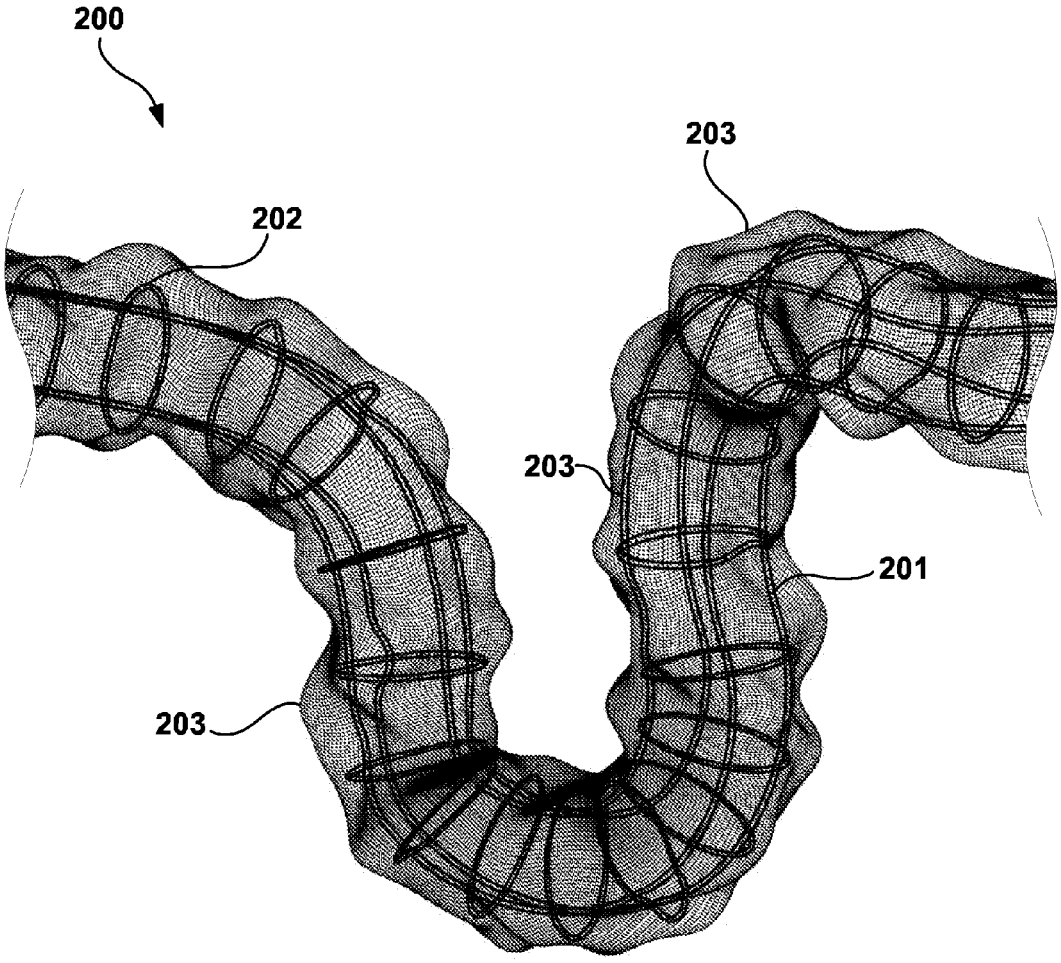
FIG. 2B illustrates a wire mesh that is operably attached to the armature.

FIG. 2B illustrates a wire mesh 203 that is operably attached to the armature 200. In other words, the wire mesh 203 is attached to the armature 200 in a manner that allows for malleability so that the wire mesh 203 takes the shape of the artificial prop, but that is stiff and durable enough to withstand inclement weather conditions such as wind. The wire mesh 203 can be clipped, nailed, screwed, welded, etc., to the plurality of wires 201 and/or the plurality of reinforcing rings 202 of FIG. 2A. The wire mesh 203 can be constructed from steel or another material that is selected based upon factors such as rigidity, malleability, cost, fire resistance, environmental robustness, etc. The wire mesh 203 is shaped to take the form of the artificial prop, e.g., a tree branch.

Figure 3A:
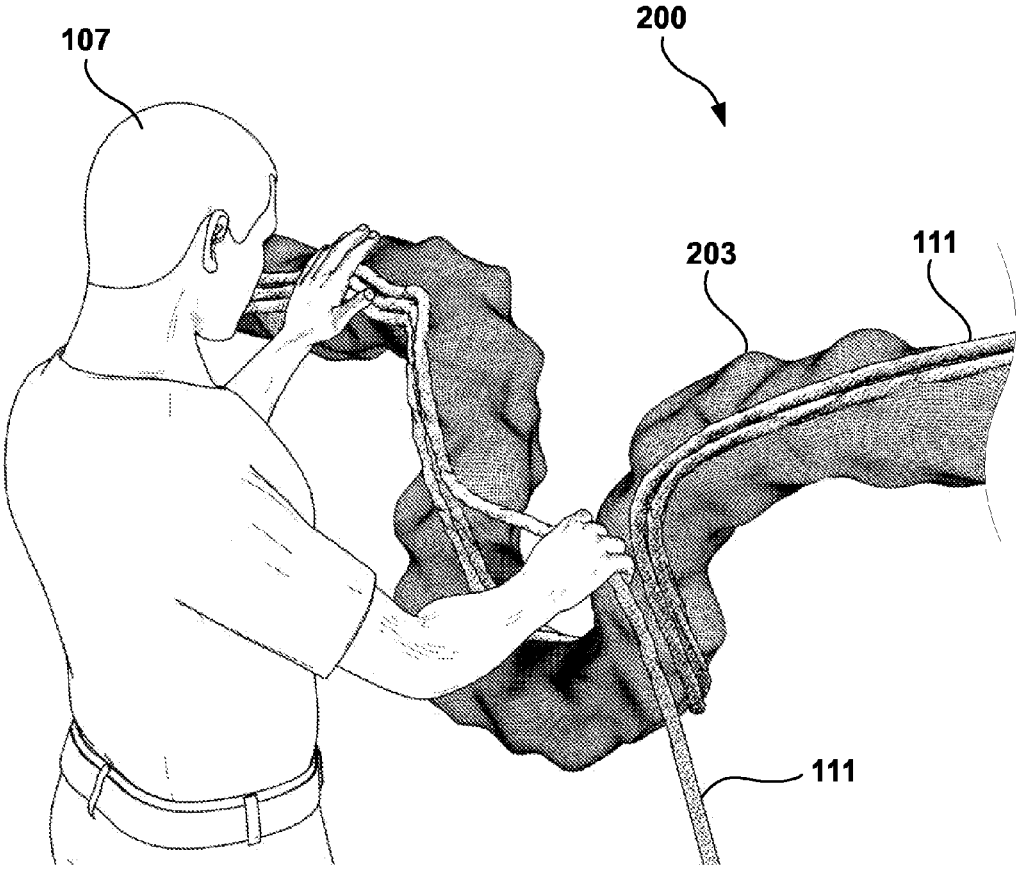
FIG. 3A illustrates the human applying the composite rope illustrated in FIG. 1B to the wire mesh illustrated in FIG. 2B.

FIG. 3A illustrates the operator 107 applying the composite rope 111 illustrated in FIG. 1B to the wire mesh 203 illustrated in FIG. 2B. The composite rope 111 is used to resemble a vine that is attached to a branch.

Figure 3B:
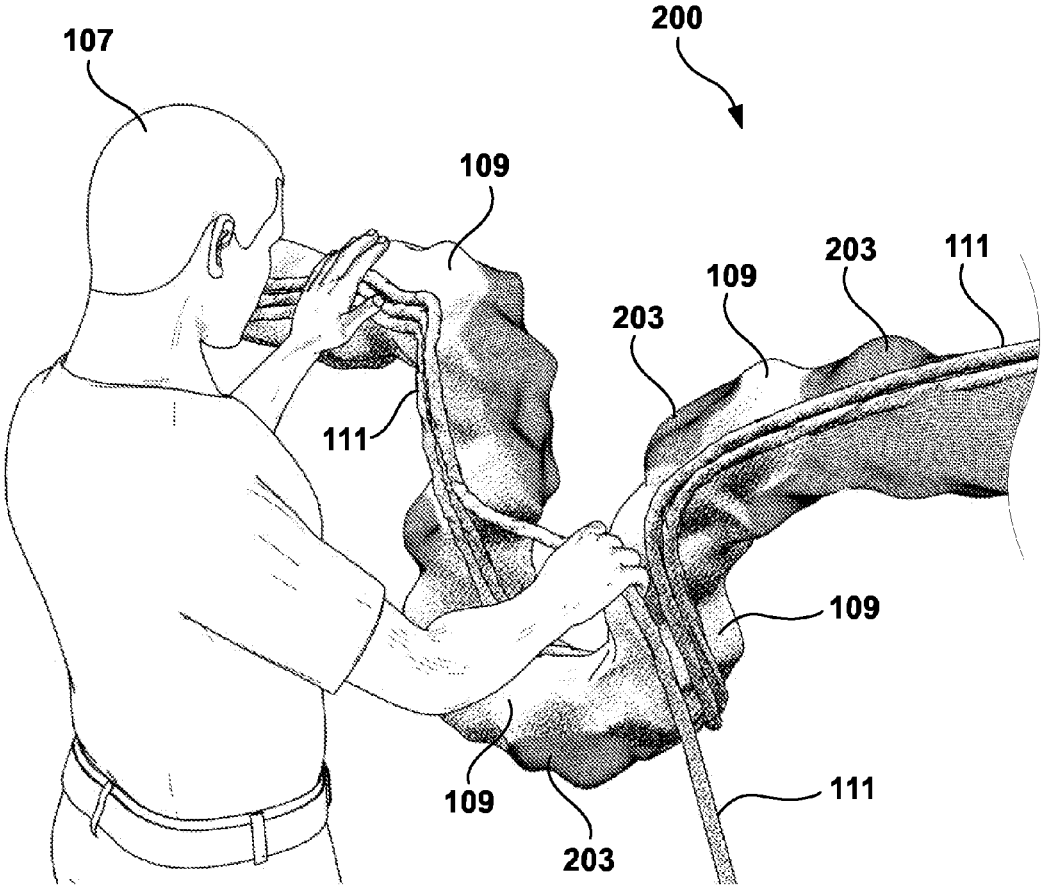
FIG. 3B illustrates the epoxy partially applied to the wire mesh.
Figure 3C:
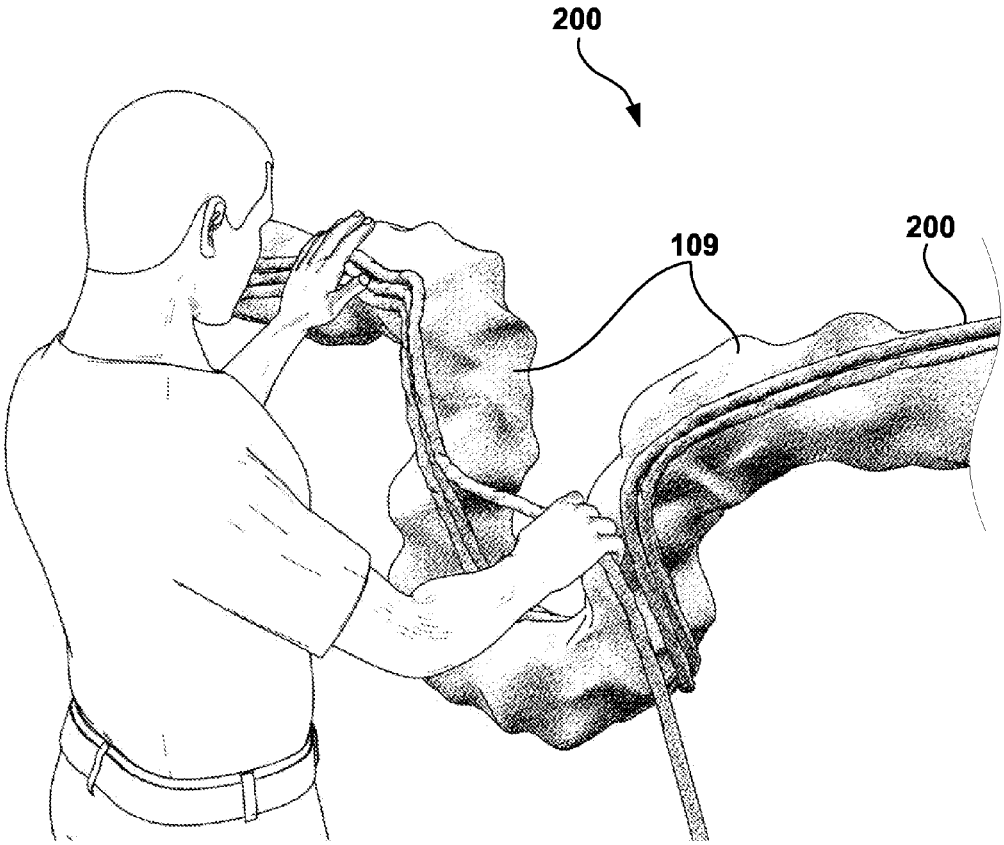

FIG. 3B illustrates the epoxy 109 partially applied to the wire mesh 203. The same epoxy 109 that is used to coat the composite rope 111 is also used to coat the wire mesh 203 so that the color of the artificial tree branch resembles the color of the artificial tree vines. FIG. 3C illustrates the epoxy 109 fully coating the wire mesh 203.

Figure 4:
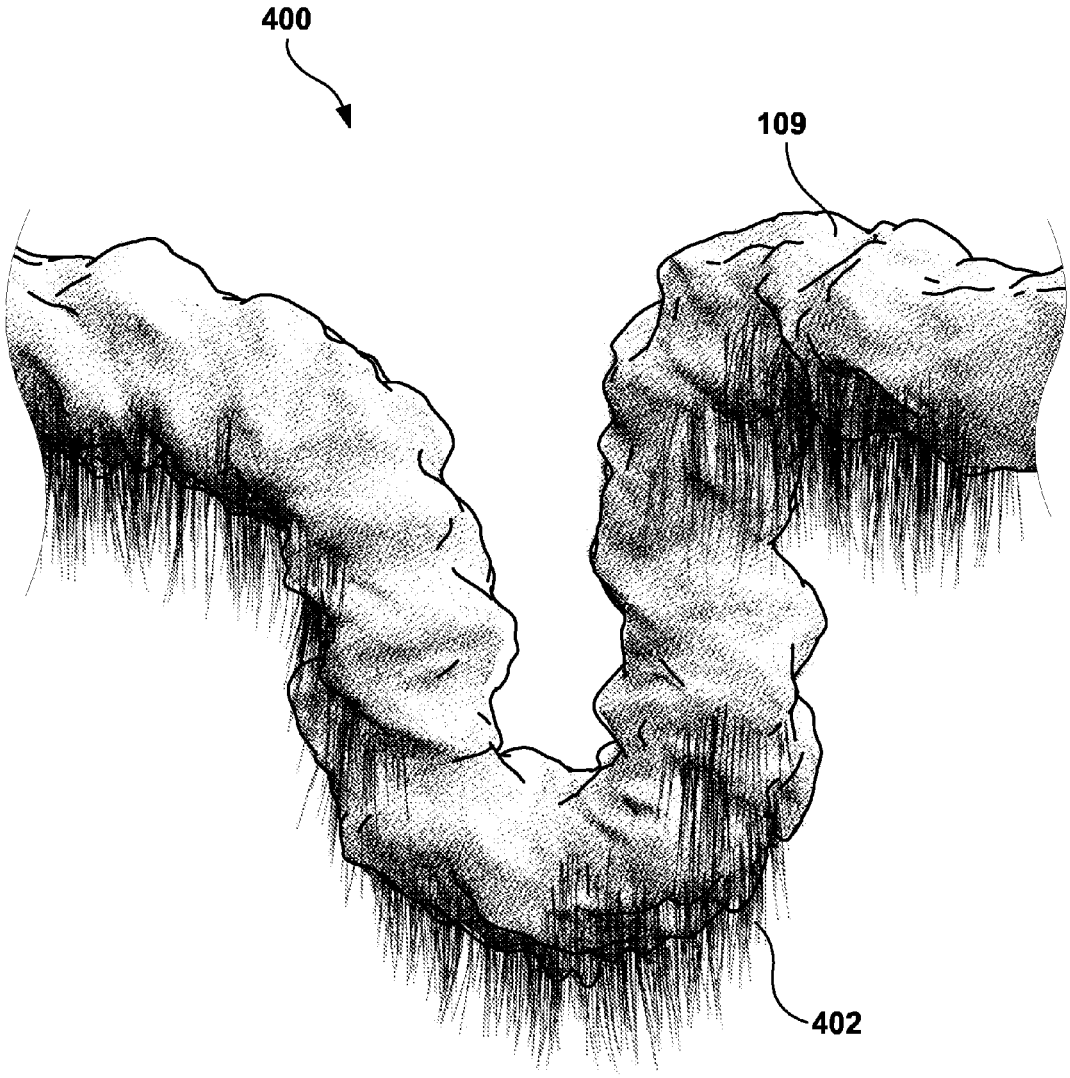
FIG. 4 illustrates an artificial prop that is constructed via the epoxy application process illustrated in FIGS. 1A-3C.

FIG. 4 illustrates an artificial prop 400 that is constructed via the epoxy application process illustrated in FIGS. 1A-3C. As an example, the artificial prop is a tree branch with vines. Artificial moss 402 is added to provide further realism to the artificial prop 400.

The epoxy 109 of the composite rope 111 can be cured according to a variety of curing mechanisms to ensure that the composite rope 111 is heat resistant. For example, catalyst/UV stimulation, heat simulation, etc. may be used to cure the composite rope 111. Further, homopolymerisation is a process by which the epoxy 109 is reacted with itself. Curing may also be performed by forming a copolymer with a hardener or polyfunctional curative.

It is understood that the apparatuses and processes may also be applied in other types of apparatuses and processes. Those skilled in the art will appreciate that the various adaptations and modifications of the aspects of the apparatuses and processes described herein may be configured without departing from the scope and spirit of the present apparatuses and processes. Therefore, it is to be understood that, within the scope of the appended claims, the present apparatuses and processes may be practiced other than as specifically described herein.

I claim:

1. A method comprising:

providing two or more strands of rope formed of a fibrous matrix material;

threading the strands singly and in parallel under tension into a coating container;

applying a curable fluid matrix to at least some of the strands;

drawing the strands through a constricting orifice to bond them together along their length to form a composite rope;

operably attaching the composite rope to a steel mesh that has a shape of an artificial prop; and curing the composite rope to form a rigid structure after the act of operably attaching.

2. The method of claim 1, further comprising operably attaching the steel mesh to a steel armature that surrounds the artificial prop.

3. The method of claim 1, further comprising applying the curable fluid matrix to the steel mesh.

4. The method of claim 1, further comprising applying a vine texture cladding to an outer surface of the composite rope.

* * * * *